US008181749B2

(12) United States Patent
Okada

(10) Patent No.: US 8,181,749 B2
(45) Date of Patent: May 22, 2012

(54) SPEED GOVERNOR FOR AN ELEVATOR

(75) Inventor: Mineo Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 426 days.

(21) Appl. No.: 12/597,172

(22) PCT Filed: Aug. 9, 2007

(86) PCT No.: PCT/JP2007/065610

§ 371 (c)(1),
(2), (4) Date: Oct. 23, 2009

(87) PCT Pub. No.: WO2009/019780

PCT Pub. Date: Feb. 12, 2009

(65) Prior Publication Data

US 2011/0186385 A1 Aug. 4, 2011

(51) Int. Cl.
*B66B 5/06* (2006.01)

(52) U.S. Cl. ..... 187/287; 187/393

(58) Field of Classification Search ..... 187/247, 187/277, 286, 287, 293, 296, 297, 305, 314, 187/391–393

See application file for complete search history.

(56) References Cited

U.S. PATENT DOCUMENTS

| | | | | |
|---|---|---|---|---|
| 6,170,614 | B1 * | 1/2001 | Herkel et al. | 187/287 |
| 6,227,334 | B1 * | 5/2001 | Yumura et al. | 187/359 |
| 6,360,847 | B1 | 3/2002 | Okada et al. | |
| 7,014,014 | B2 * | 3/2006 | Mueller | 187/305 |
| 8,069,956 | B2 * | 12/2011 | Okada | 187/287 |
| 2003/0106747 | A1 * | 6/2003 | Sasaki | 187/373 |
| 2011/0203878 | A1 * | 8/2011 | Kawakami | 187/247 |

FOREIGN PATENT DOCUMENTS

| | | |
|---|---|---|
| JP | 56 51994 | 12/1981 |
| JP | 2000 327241 | 11/2000 |
| WO | 2008 047425 | 4/2008 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

In a speed governor for an elevator, a clutch mechanism is provided between a governor sheave and a rotary body. An actuator performs switching between transmission and interruption of rotation by the clutch mechanism according to whether or not energization from a DC generator, which generates a current by rotation of the governor sheave, is performed. A rectifier circuit allows the current to flow from the DC generator to the actuator only when a rotating direction of the governor sheave is a predetermined one of a first direction and a second direction.

5 Claims, 10 Drawing Sheets

SPEED GOVERNOR FOR AN ELEVATOR

TECHNICAL FIELD

The present invention relates to a speed governor for an elevator, which detects that a running speed of a car has reached a preset overspeed.

BACKGROUND ART

In recent years, an elevator having a rated speed for ascent of a car, which is set higher than that for descent, has been proposed. A conventional speed governor used for such an elevator includes a clutch mechanism provided between a governor sheave rotated by running of the car and a rotary body which is rotated by transmission of the rotation of the governor sheave. The clutch mechanism transmits the rotation from the governor sheave to the rotary body when the car descends, whereas the clutch mechanism interrupts the transmission of the rotation from the governor sheave to the rotary body when the car ascends. Moreover, a mechanism for detecting an excess of a running speed when the car descends is mounted to the rotary body. Further, a mechanism for detecting the excess of the running speed when the car ascends is mounted to the governor sheave (for example, see Patent Document 1).

Patent Document 1: JP 2000-327241 A

DISCLOSURE OF THE INVENTION

Problem to be Solved by the Invention

For the conventional speed governor as described above, how to drive the clutch mechanism is not stated. With a general driving method, external power feeding is disadvantageously required.

The present invention has been made to solve the problem described above, and therefore has an object to provide a speed governor for an elevator, which is capable of monitoring a running speed of a car by using different threshold values for ascent and descent of a car without requiring external power feeding.

Means for Solving the Problem

A speed governor for an elevator according to the present invention includes: a governor sheave, around which a governor rope connected to a car is wound, the governor sheave being rotated in a first direction along with ascent of the car and being rotated in a second direction opposite to the first direction along with descent of the car; a first speed detecting mechanism provided to the governor sheave to detect based on rotation of the governor sheave that a running speed of the car has reached a first threshold value; a rotary body to be rotated by transmission of the rotation of the governor sheave; a second speed detecting mechanism provided to the rotary body to detect based on rotation of the rotary body that the running speed of the car has reached a second threshold value smaller than the first threshold value; a clutch mechanism provided between the governor sheave and the rotary body to transmit and interrupt rotation between the governor sheave and the rotary body; a DC generator for generating a current by the rotation of the governor sheave; an actuator for performing switching between transmission and interruption of rotation by the clutch mechanism according to whether or not energization from the DC generator is performed; and a rectifier circuit for allowing the current to flow from the DC generator to the actuator only when a rotating direction of the governor sheave is a predetermined one of the first direction and the second direction.

Further, a speed governor for an elevator according to the present invention includes: a governor sheave, around which a governor rope connected to a car is wound, the governor sheave being rotated in a first direction along with ascent of the car and being rotated in a second direction opposite to the first direction along with descent of the car; a speed detecting mechanism including an operating member to be displaced according to a rotating speed of the governor sheave and a detection switch to be operated by the operating member; a DC generator for generating a current by rotation of the governor sheave; an actuator for changing a relative positional relation between the operating member and the detection switch according to whether or not energization from the DC generator is performed; and a rectifier circuit for allowing the current to flow from the DC generator to the actuator only when a rotating direction of the governor sheave is a predetermined one of the first direction and the second direction.

BEST MODES FOR CARRYING OUT THE INVENTION

Figure 1:
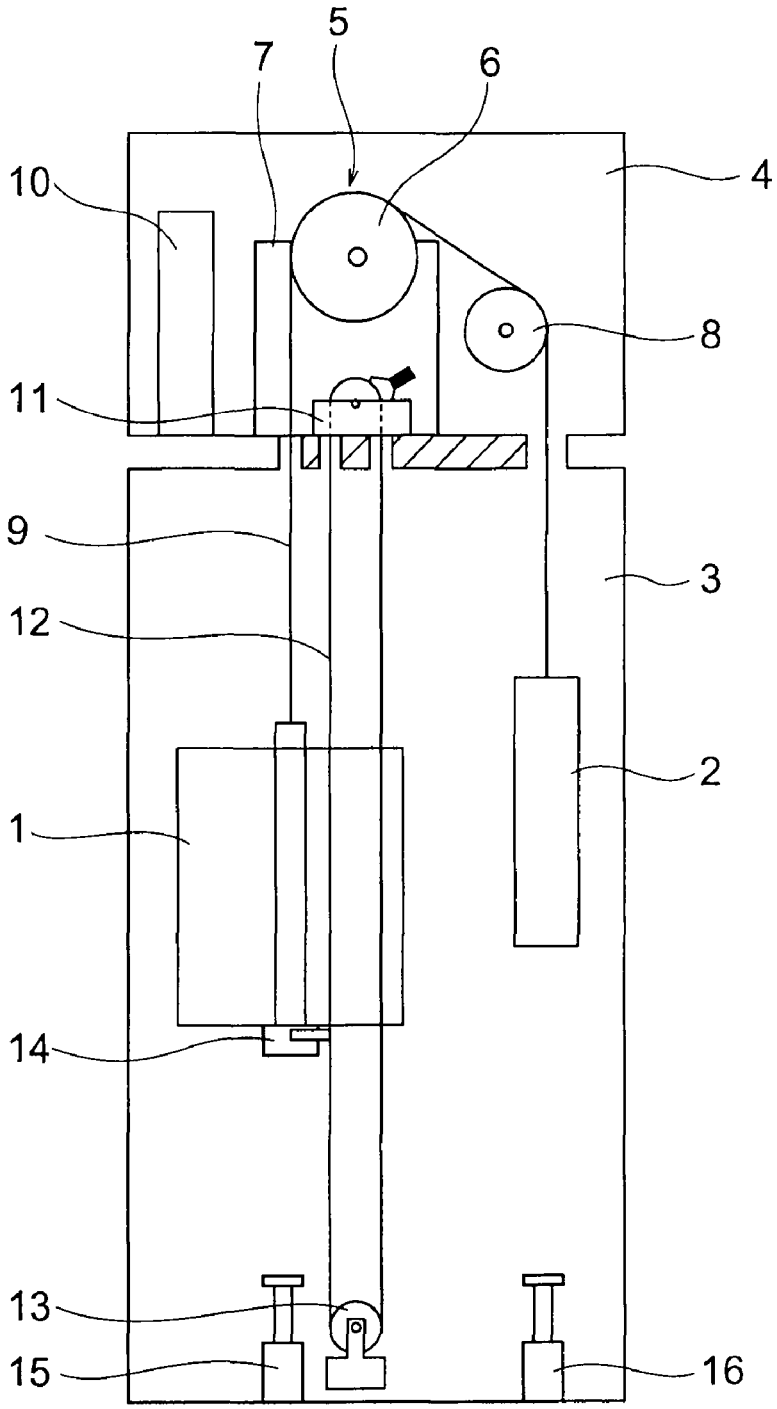
FIG. 1 is a configuration diagram illustrating an elevator apparatus according to a first embodiment of the present invention.

Hereinafter, preferred embodiments of the present invention are described referring to the drawings.

First Embodiment

FIG. 1 is a configuration diagram illustrating an elevator apparatus according to a first embodiment of the present invention. In the drawing, a car 1 and a counterweight 2 are ascended and descended in a hoistway 3. In an upper part of the hoistway 3, a machine room 4 is provided. In the machine room 4, a hoisting machine 5 for ascending and descending the car 1 and the counterweight 2 is provided. The hoisting machine 5 includes a driving sheave 6 and a hoisting machine main body 7 for rotating the driving sheave 6 and braking the rotation of the driving sheave 6.

In the vicinity of the hoisting machine 5, a deflector sheave 8 is provided. A plurality of main ropes 9 (only one thereof is illustrated in the drawing) are wound around the driving sheave 6 and the deflector sheave 8. The car 1 is suspended at a first end of each of the main ropes 9. The counterweight 2 is suspended at a second end of each of the main ropes 9.

In the machine room 4, an elevator controller 10 and a speed governor 11 are provided. The elevator controller 10 controls the hoisting machine 5. Specifically, the ascent and descent of the car 1 is controlled by the elevator controller 10. Moreover, a rated speed for descent at the time when the car 1 descends and a rated speed for ascent at the time when the car 1 ascends are set for the elevator controller 10. Further, the rated speed for ascent is set higher than the rated speed for descent.

The speed governor 11 detects that the car 1 has reached a preset overspeed to bring the car 1 to an emergency stop. An upper end portion of a speed governor rope 12 is wound around the speed governor 11. A lower end of the speed governor rope 12 is wound around a tension sheave 13 provided in a lower part of the hoistway 3. The governor rope 12 is connected to a safety gear 14 mounted to the car 1. On a bottom of the hoistway 3, a car buffer 15 and a counterweight buffer 16 are provided.

Figure 2:
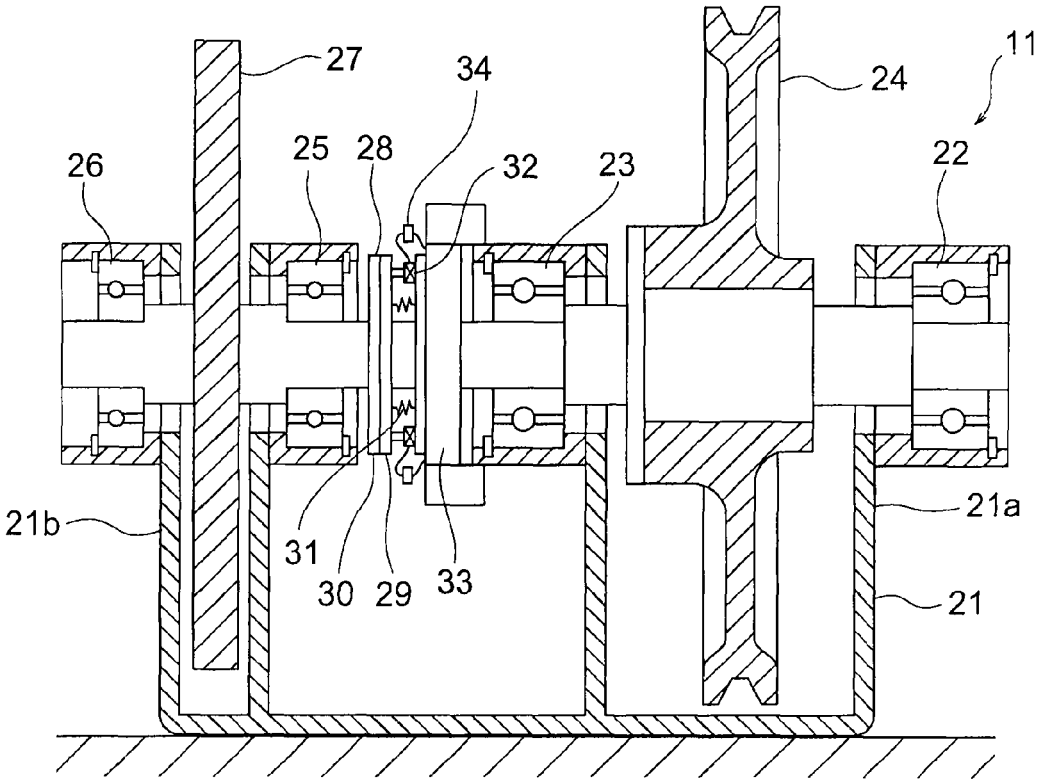
FIG. 2 is a sectional view of a speed governor illustrated in FIG. 1.

FIG. 2 is a sectional view of the speed governor 11 illustrated in FIG. 1. A support table 21 is provided with a governor sheave supporting portion 21*a* and a rotary body supporting portion 21*b*. A governor sheave 24 is rotatably supported by the governor sheave supporting portion 21*a* through an intermediation of a first governor sheave bearing 22 and a second governor sheave bearing 23.

A rotary shaft of the governor sheave 24 is horizontally arranged. The governor rope 12 is wound around an outer circumferential portion of the governor sheave 24. As a result, the governor sheave 24 is rotated in a first direction along with the ascent of the car 1, whereas the governor sheave 24 is rotated in a second direction opposite to the first direction along with the descent of the car 1.

A disc-like rotary body 27 is rotatably supported by the rotary body supporting portion 21*b* through an intermediation of a first rotary body bearing 25 and a second rotary body bearing 26. The rotary body 27 is arranged coaxially with the governor sheave 24. The rotation of the governor sheave 24 is transmitted to the rotary body 27 to rotate the rotary body 27 with the governor sheave 24 in an integrated fashion.

A clutch mechanism 28 for transmitting and interrupting the rotation between the governor sheave 24 and the rotary body 27 is provided between the rotary shaft of the governor sheave 24 and a rotary shaft of the rotary body 27. The clutch mechanism 28 includes a first clutch plate 29 which is rotated with the governor sheave 24 in an integrated fashion and a second clutch plate 30 which is rotated with the rotary body 27 in an integrated fashion. The first clutch plate 29 can be moved into contact with and away from the second clutch plate 30.

A plurality of clutch pressure springs 31, a plurality of actuators 32, a DC generator 33, and a plurality of rectifier circuits 34 are supported by the governor sheave supporting portion 21*a*. The clutch pressure springs 31 bias the first clutch plate 29 in such a direction that the first clutch plate 29 is brought into contact with the second clutch plate 30.

The actuators 32 perform switching between the transmission and the interruption of the rotation to be performed by the clutch mechanism 28. Specifically, the actuators 32 generate a driving force for separating the first clutch plate 29 away from the second clutch plate 30 against the clutch pressure springs 31. As the actuators 32, electromagnetic actuators, each including a solenoid coil, are used.

The DC generator 33 is provided around the rotary shaft of the governor sheave 24 and generates a current by the rotation of the governor sheave 24. The rectifier circuits 34 are electrically connected between the DC generator 33 and the solenoid coils of the respective actuators 32 and allow the solenoid coils to be energized with only any one of a positive current and a negative current. Specifically, only when the rotating direction of the governor sheave 24 is a predetermined one of the first and second directions, the rectifier circuits 34 allow the current to flow from the DC generator 33 to the solenoid coils.

In this example, the rectifier circuits 34 allow the current to flow from the DC generator 33 to the actuators 32 when the rotating direction of the governor sheave 24 is the first direction, specifically, when the car 1 ascends. Moreover, the actuators 32 interrupt the transmission of the rotation by the clutch mechanism 28 when the current is made to flow from the DC generator 33, whereas the actuators 32 allow the clutch mechanism 28 to transmit the rotation when the current from the DC generator 33 is interrupted by the rectifier circuits 34.

Figure 3:
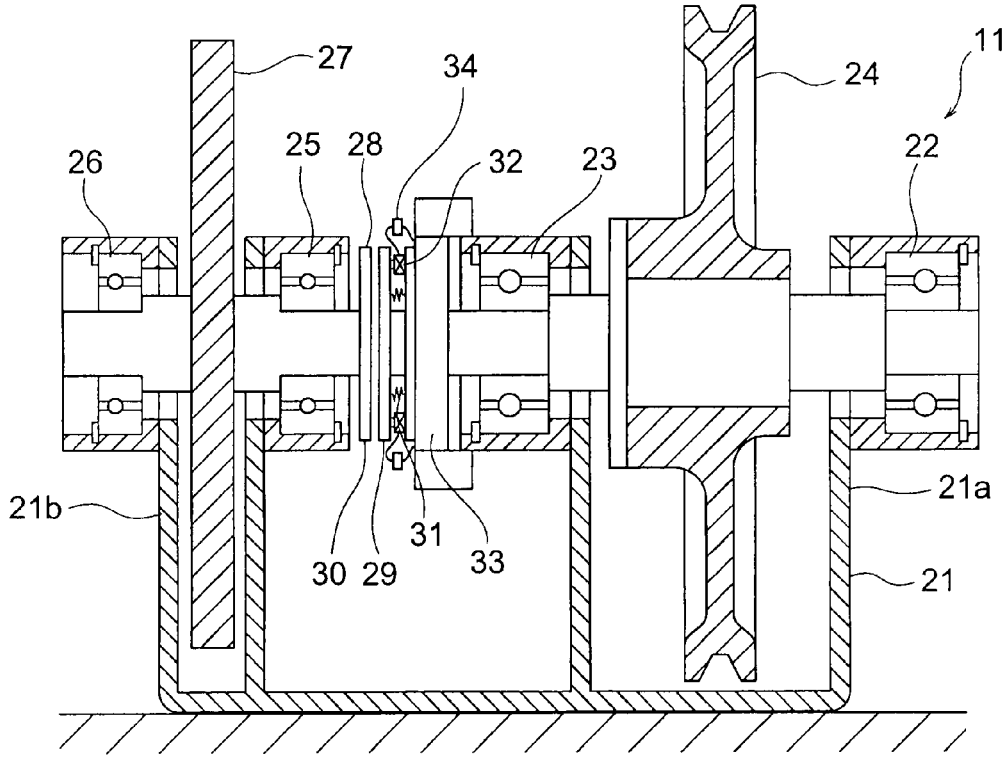
FIG. 3 is a sectional view illustrating a state where a first clutch plate illustrated in FIG. 2 is separated away from a second clutch plate.

Therefore, when the car 1 ascends, the first clutch plate 29 is separated away from the second clutch plate 30 to allow only the governor sheave 24 to rotate, as illustrated in FIG. 3. When the car 1 descends, the first clutch plate 29 is brought into contact with the second clutch plate 30 to allow the rotary body 27 to rotate with the governor sheave 24.

Figure 4:
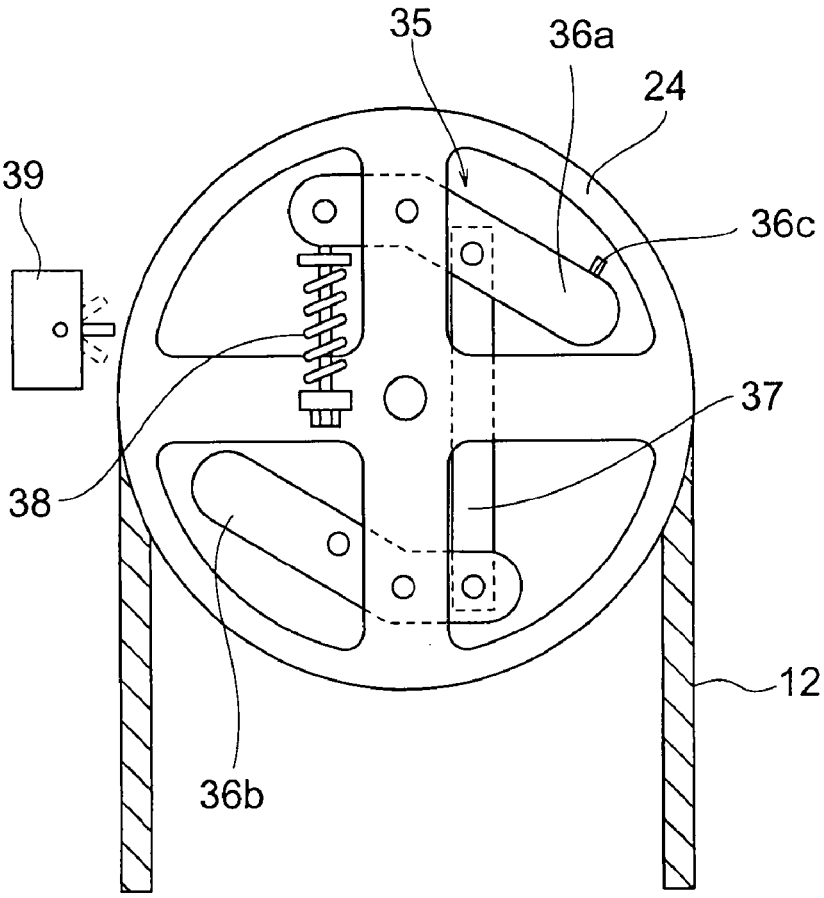
FIG. 4 is a front view illustrating a governor sheave illustrated in FIG. 2.

FIG. 4 is a front view illustrating the governor sheave 24 illustrated in FIG. 2. A first speed detecting mechanism 35 is provided to the governor sheave 24 though omitted in FIGS. 2 and 3. The first speed detecting mechanism 35 detects based on the rotation of the governor sheave 24 that a running speed (ascending speed) of the car 1 has reached a first threshold value. The first threshold value is set about 1.3 times as large as the rated speed for ascent.

The first speed detecting mechanism 35 includes a pair of first flyweights 36*a* and 36*b*, a first link 37, a first balance spring 38, and a first detection switch 39. The first flyweights 36*a* and 36*b* are turnably mounted to the governor sheave 24. The first link 37 is connected between the first flyweights 36*a* and 36*b*. The first balance spring 38 is provided between the governor sheave 24 and the first flyweight 36*a*.

The first detection switch 39 is provided to the governor sheave supporting portion 21*a*. The first flyweight 36*a* is provided with a first operating pin 36*c* for operating the first detection switch 39.

The governor sheave 24 is rotated at a speed according to the running speed of the car 1. At this time, the first flyweights 36*a* and 36*b* are subjected to a centrifugal force corresponding to the rotating speed of the governor sheave 24, that is, the running speed of the car 1. Then, when the running speed of the car 1 becomes a predetermined value or larger, the first flyweights 36*a* and 36*b* are turned against the first balance spring 38.

Further, when the running speed of the car 1 reaches the first threshold value, the first detection switch 39 is operated by the first operating pin 36*c*. As a result, a power supply to a motor of the hoisting machine 5 is interrupted. In addition, the car 1 is brought to an emergency stop by a brake of the hoisting machine 5.

Figure 5:
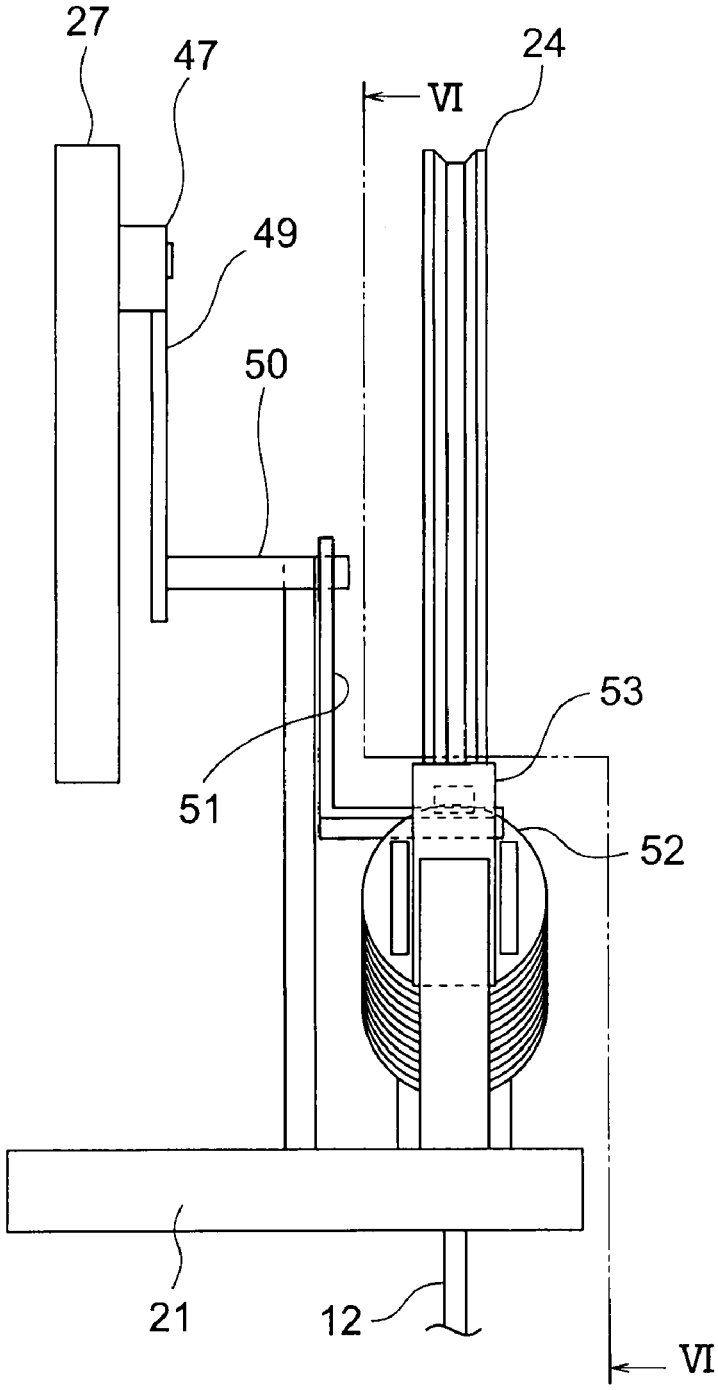
FIG. 5 is a side view illustrating a principal part of the speed governor illustrated in FIG. 1.
Figure 6:
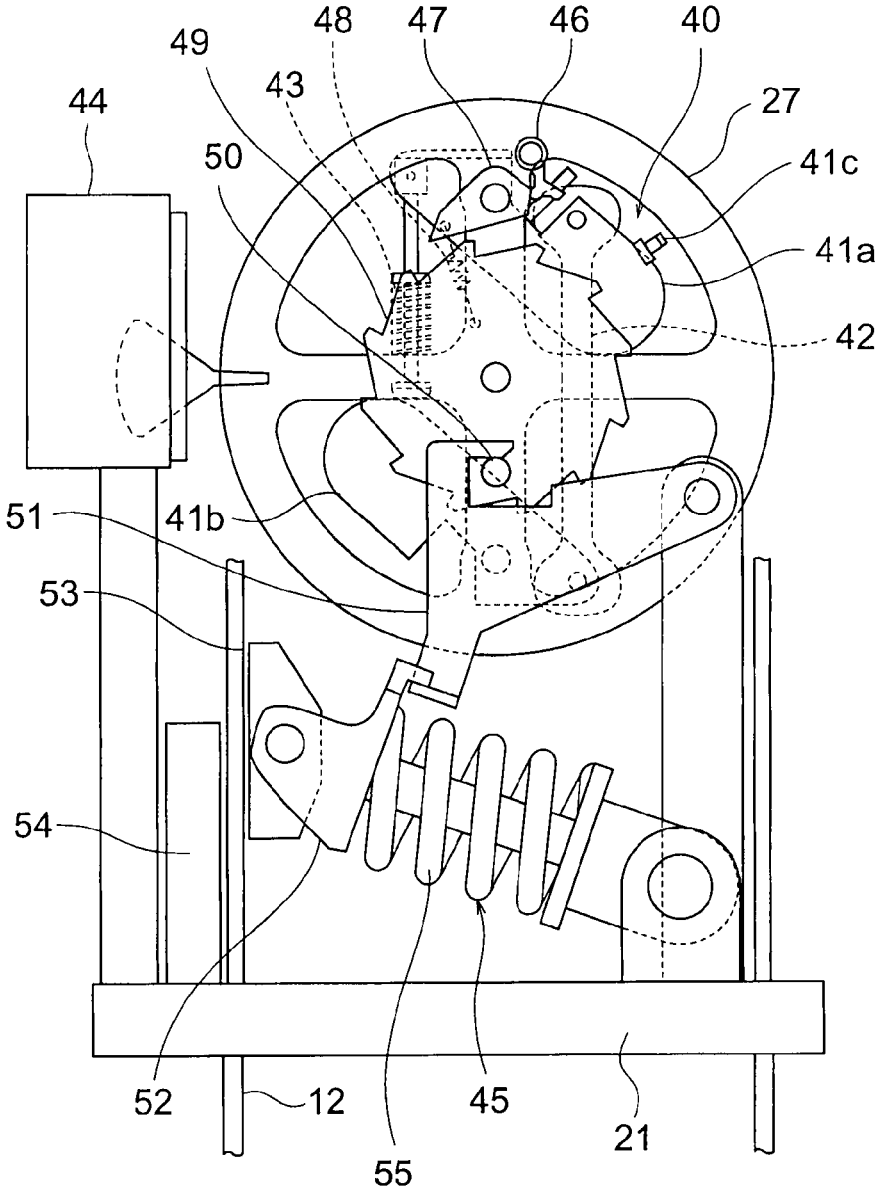
FIG. 6 is a front view illustrating the speed governor illustrated in FIG. 5 as viewed along the line VI-VI.

FIG. 5 is a side view illustrating a principal part of the speed governor 11 illustrated in FIG. 1, and FIG. 6 is a front view of the speed governor 11 illustrated in FIG. 5 as viewed along the line VI-VI. A second speed detecting mechanism 40 is provided to the rotary body 27 though omitted in FIGS. 2 and 3. The second speed detecting mechanism 40 detects based on the rotation of the rotary body 27 that a running speed (descending speed) of the car 1 has reached a second threshold value which is lower than a first threshold value. The second threshold value is set about 1.3 times as large as the rated speed for descent.

The second speed detecting mechanism 40 includes a pair of second flyweights 41*a* and 41*b*, a second link 42, a second balance spring 43, and a second detection switch 44. The second flyweights 41*a* and 41*b* are turnably mounted to the rotary body 27. The second link 42 is connected between the second flyweights 41*a* and 41*b*. The second balance spring 43 is provided between the rotary body 27 and the second flyweight 41*a*.

The second detection switch 44 is provided to the rotary body supporting portion 21*b*. The second flyweight 41*a* is provided with a second operating pin 41*c* for operating the second detection switch 44.

The rotary body 27 is rotated at a speed according to the running speed when the car 1 descends. At this time, the second flyweights 41*a* and 41*b* are subjected to a centrifugal force corresponding to the rotating speed of the rotary body 27, that is, the running speed of the car 1. Then, when the running speed of the car 1 becomes a predetermined value or larger, the second flyweights 41*a* and 41*b* are turned against the second balance spring 43.

Further, when the running speed of the car 1 reaches the second threshold value, the second detection switch 44 is operated by the second operating pin 41*c*. As a result, the power supply to a motor of the hoisting machine 5 is interrupted. In addition, the car 1 is brought to an emergency stop by a brake of the hoisting machine 5.

Moreover, the speed governor 11 is provided with a safety gear operating mechanism (third speed detecting mechanism) 45 for operating the safety gear 14. The safety gear operating mechanism 45 includes a trip lever 46, a claw 47, a tension spring 48, a ratchet 49, a support pin 50, a support hook 51, a rope grip support 52, a movable-side rope grip 53, a fixed-side rope grip 54, and a rope gripping spring 55.

Each of the trip lever 46 and the claw 47 is turnably mounted to the rotary body 27. The tension spring 48 is provided between the rotary body 27 and the claw 47 to bias the claw 47 in such a direction that the claw 47 meshes with teeth of the ratchet 49. The trip lever 46 is engaged with the claw 47. As a result, the claw 47 is held away from the ratchet 49.

The ratchet 49 is arranged coaxially with the rotary shaft of the rotary body 27. In general, the ratchet 49 is stopped even when the rotary body 27 is rotated. By meshing with the claw 47, the ratchet 49 is rotated together with the rotary body 27.

A proximal end portion of the support pin 50 is fixed to the ratchet 49. The support hook 51 is engaged with a distal end portion of the support pin 50. The rope gripping support 52 is engaged with the support hook 51.

The movable-side rope grip 53 is supported by the rope gripping support 52. While the rope gripping support 52 is engaged with the support hook 51, the movable-side rope grip 53 is away from the governor rope 12. The fixed-side rope grip 54 is fixed onto the support table 21.

When the running speed (descending speed) of the car 1 exceeds the second threshold value to reach a third threshold value (for example, about 1.4 times as large as the rated speed for descent), the second flyweights 41*a* and 41*b* are further turned to disengage the trip lever 46 from the claw 47. When the trip lever 46 is disengaged from the claw 47, the claw 47 is turned by the tension spring 48 to cause the claw 47 to mesh with the teeth of the ratchet 49.

When the car 1 descends, the rotary body 27 is rotated in a counterclockwise direction of FIG. 6. Therefore, when the claw 47 meshes with the ratchet 49, the ratchet 49 is also rotated in the counterclockwise direction of FIG. 6. By the rotation of the ratchet 49, the support pin 50 is disengaged from the support hook 51. Subsequently, the support hook 51 is turned by gravity to disengage the support hook 51 from the rope grip support 52.

Figure 7:
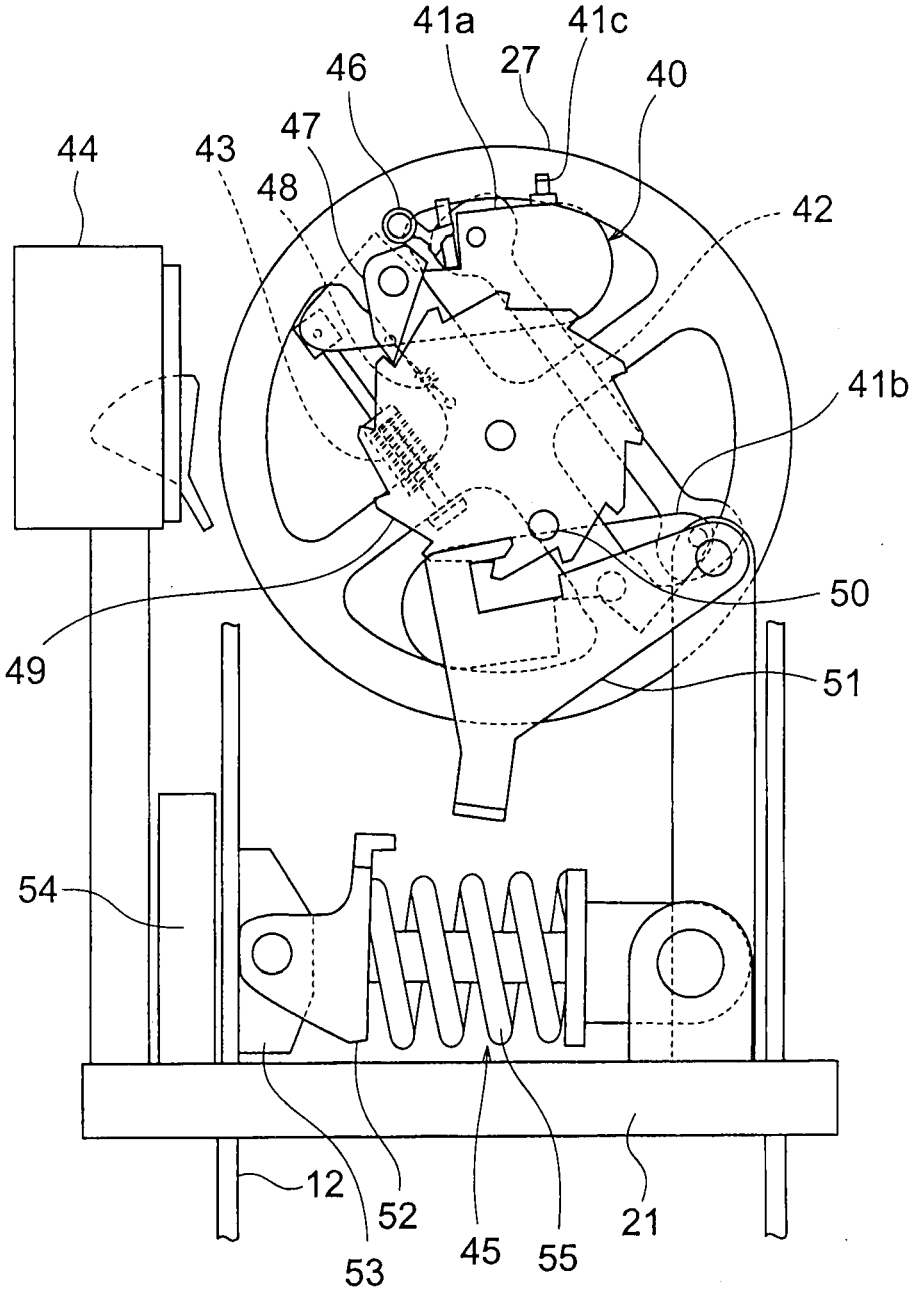
FIG. 7 is a front view illustrating a state where a safety gear operating mechanism illustrated in FIG. 6 operates.

As a result, the rope grip support 52 moves downward by the gravity to cause the governor rope 12 to be interposed between the movable-side rope grip 53 and the fixed-side rope grip 54, thereby compressing the rope gripping spring 55. FIG. 7 is a front view illustrating a state where the safety gear operating mechanism 45 illustrated in FIG. 6 operates. The governor rope 12 is gripped between the rope grips 53 and 54. As a result, cyclic movement of the governor rope 12 is stopped to cause the safety gear 14 to perform a braking operation.

In the speed governor 11 as described above, the DC generator 33 for generating the current by the rotation of the governor sheave 24 is provided to the governor sheave supporting portion 21*a*, whereas the rectifier circuits 34 are provided between the actuators 32 for performing switching between the transmission and the interruption of the rotation to be performed by the clutch mechanism 28 and the DC generator 33. In this manner, the actuators 32 are energized with the current from the DC generator 33 to separate the first clutch plate 29 away from the second clutch plate 30 only when the car 1 ascends. Therefore, the running speed of the car 1 can be monitored using different threshold values respectively for the ascent and the descent of the car 1 without requiring external power feeding (that is, even when electric power failure occurs).

Moreover, in the case where the first clutch plate 29 cannot be separated away from the second clutch plate 30 for some reason, the car 1 is brought to an emergency stop at the second threshold value which is lower than the first threshold value regardless of the running direction of the cart. Therefore, a fail-safe function is ensured, thereby providing high reliability even at the time of occurrence of a failure.

The first threshold value is set based on the rated speed for ascent, whereas the third threshold value is set based on the rated speed for descent. Thus, any one of the first threshold value and the third threshold value may be larger than the other.

Second Embodiment

Figure 8:
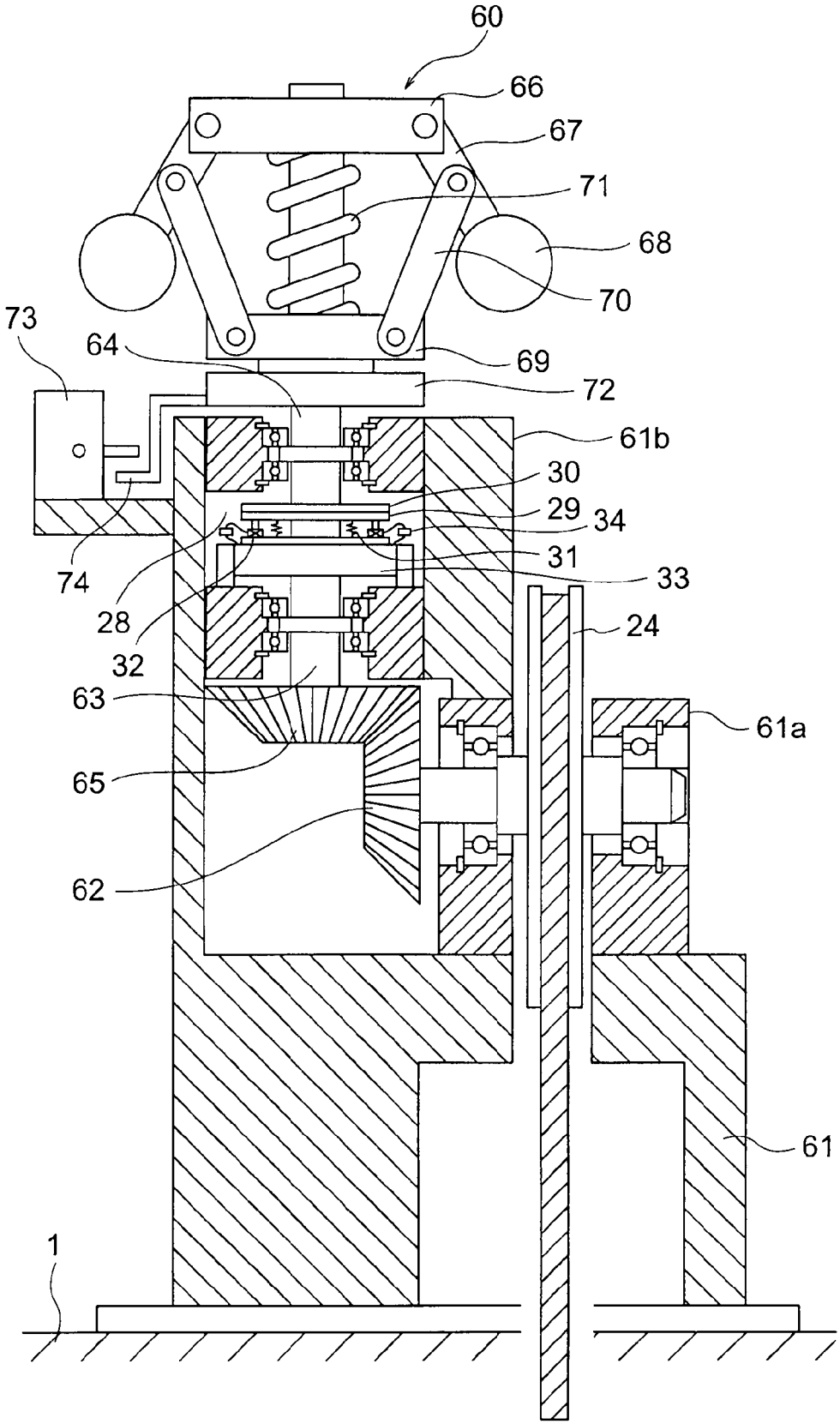
FIG. 8 is a sectional view of the speed governor for the elevator according to a second embodiment of the present invention.

Next, FIG. 8 is a sectional view of the speed governor for the elevator according to a second embodiment of the present invention. In the drawing, a governor sheave supporting portion 61*a* and a rotary body supporting portion 61*b* are provided to a support table 61. The governor sheave 24 is rotatably supported by the governor sheave supporting portion 61*a*. The rotary shaft of the governor sheave 24 is horizontally arranged.

The governor rope 12 is wound around the outer circumferential portion of the governor sheave 24. As a result, the governor sheave 24 is rotated in the first direction along with the ascent of the car 1, whereas the governor sheave 24 is rotated in the second direction which is opposite to the first direction along with the descent of the car 1. Moreover, the first speed detecting mechanism 35 as illustrated in FIG. 4 is provided to the governor sheave 24.

A first bevel gear 62 is fixed to the rotary shaft of the governor sheave 24. A first vertical shaft 63 and a second vertical shaft 64 are rotatably held by the rotary body supporting portion 61*b* therein. The second vertical shaft 64 corresponding to a rotary body is arranged above the first vertical shaft 63 to be coaxial with the first vertical shaft 63. A second bevel gear 65 which meshes with the first bevel gear 62 is fixed to a lower end portion of the first vertical shaft 63.

The clutch mechanism 28 for transmitting and interrupting the rotation between the first vertical shaft 63 and the second vertical shaft 64 is provided between the first vertical shaft 63 and the second vertical shaft 64. The clutch mechanism 28 includes the first clutch plate 29 which is rotated with the first vertical shaft 63 in an integrated fashion and the second clutch plate 30 which is rotated with the second vertical shaft 64 in an integrated fashion. The first clutch plate 29 can be moved into contact with and away from the second clutch plate 30.

The plurality of clutch pressure springs 31, the plurality of actuators 32, the DC generator 33, and the plurality of rectifier circuits 34 are supported by the rotary body supporting portion 61*b*. The clutch pressure springs 31 bias the first clutch plate 29 in such a direction that the first clutch plate 29 is brought into contact with the second clutch plate 30.

The actuators 32 perform switching between the transmission and the interruption of the rotation to be performed by the clutch mechanism 28. Specifically, the actuators 32 generate the driving force for separating the first clutch plate 29 from the second clutch plate 30 against the clutch pressure springs 31. As the actuators 32, the electromagnetic actuators, each including the solenoid coil, are used.

The DC generator 33 is provided around the first vertical shaft 63 and generates a current by the rotation of the first vertical shaft 63. The rectifier circuits 34 are electrically connected between the DC generator 33 and the solenoid coils of the respective actuators 32 and allow the solenoid coils to be energized with only any one of a positive current and a negative current. Specifically, only when the rotating direction of the first vertical shaft 63, that is, the rotating direction of the governor sheave 24 is a predetermined one of the first and second directions, the rectifier circuits 34 allow the current to flow from the DC generator 33 to the solenoid coils.

In this example, the rectifier circuits 34 allow the current to flow from the DC generator 33 to the actuators 32 when the rotating direction of the governor sheave 24 is the first direction, specifically, when the car 1 ascends. Moreover, the actuators 32 interrupt the transmission of the rotation by the clutch mechanism 28 when the current is made to flow from the DC generator 33, whereas the actuators 32 allow the clutch mechanism 28 to transmit the rotation when the current from the DC generator 33 is interrupted by the rectifier circuits 34.

Therefore, when the car 1 ascends, the first clutch plate 29 is separated away from the second clutch plate 30. As a result, though the governor sheave 24 and the first vertical shaft 63 are rotated, the second vertical shaft 64 is not rotated. When the car 1 descends, the first clutch plate 29 is brought into contact with the second clutch plate 30 to allow the second vertical shaft 64 to rotate together with the governor sheave 24 and the first vertical shaft 63.

A second speed detecting mechanism (flyball speed governing mechanism) 65 is provided to the second vertical shaft 64. The second speed detecting mechanism 60 detects based on the rotation of the second vertical shaft 64 that the running speed (descending speed) of the car 1 has reached the second threshold value which is lower than the first threshold value. The second threshold value is set about 1.3 times as large as the rated speed for descent.

The second speed detecting mechanism 60 includes an upper rotary plate 66, a plurality of support arms 67, a plurality of flyballs 68, a lower rotary plate 69, a plurality of links 70, a second balance spring 71, a driven plate 72, a second detection switch 73, and an operating member 74.

The upper rotary plate 66 is fixed to an upper end portion of the second vertical shaft 64 and is rotated with the second vertical shaft 64 in an integrated fashion. A proximal end portion (upper end portion) of each of the support arms 67 is connected rockably to the upper rotary plate 66. The flyball 68 is fixed to a distal end portion (lower end portion) of each of the support arms 67. The lower rotary plate 69 surrounds the second vertical shaft 64 below the upper rotary plate 66.

The links 70 are respectively connected between the lower rotary plate 69 and the support arms 67. As a result, the lower rotary plate 69 is rotated together with the upper rotary plate 66. Moreover, each of the flyballs 68 is displaced obliquely upward by the centrifugal force with the proximal end portion of each of the support arms 67 being as a center. As a result, the lower rotary plate 69 is displaced upward.

The second balance spring 71 is a compression spring, and is provided between the upper rotary plate 66 and the lower rotary plate 69. The driven plate 72 surrounds the second vertical shaft 64 below the lower rotary plate 69. The driven plate 72 is connected to the lower rotary plate 69 to follow the vertical displacement of the lower rotary plate 69. Moreover, the rotation of the lower rotary plate 69 is not transmitted to the driven plate 72.

The second detection switch 73 is provided to the rotary body supporting portion 61*b*. The operating member 74 is fixed to the driven plate 72 to operate the second detection switch 73.

The second vertical shaft 64 is rotated at a speed according to the running speed when the car 1 descends. At this time, the flyballs 68 are subjected to the centrifugal force corresponding to the rotating speed of the second vertical shaft 64, that is, the running speed of the car 1. Then, when the running speed of the car 1 becomes a predetermined value or larger, the flyballs 68 are displaced obliquely upward against the second balance spring 71. With this displacement, the lower rotary plate 69, the driven plate 72, and the operating member 74 are displaced upward.

Further, when the running speed of the car 1 reaches the second threshold value, the second detection switch 73 is operated by the operating member 74. As a result, the power supply to the motor of the hoisting machine 5 is interrupted. In addition, the car 1 is brought to an emergency stop by the brake of the hoisting machine 5.

In the speed governor as described above, the DC generator 33 for generating the current by the rotation of the second vertical shaft 64, that is, the rotation of the governor sheave 24 is provided to the rotary body supporting portion 61*b*, whereas the rectifier circuits 34 are provided between the actuators 32 for performing switching between the transmission and the interruption of the rotation to be performed by the clutch mechanism 28 and the DC generator 33. In this manner, the actuators 32 are energized with the current from the DC generator 33 to separate the first clutch plate 29 away from the second clutch plate 30 only when the car 1 ascends. Therefore, the running speed of the car 1 can be monitored using different threshold values respectively for the ascent and the descent of the car 1 without requiring external power feeding.

Third Embodiment

Figure 9:
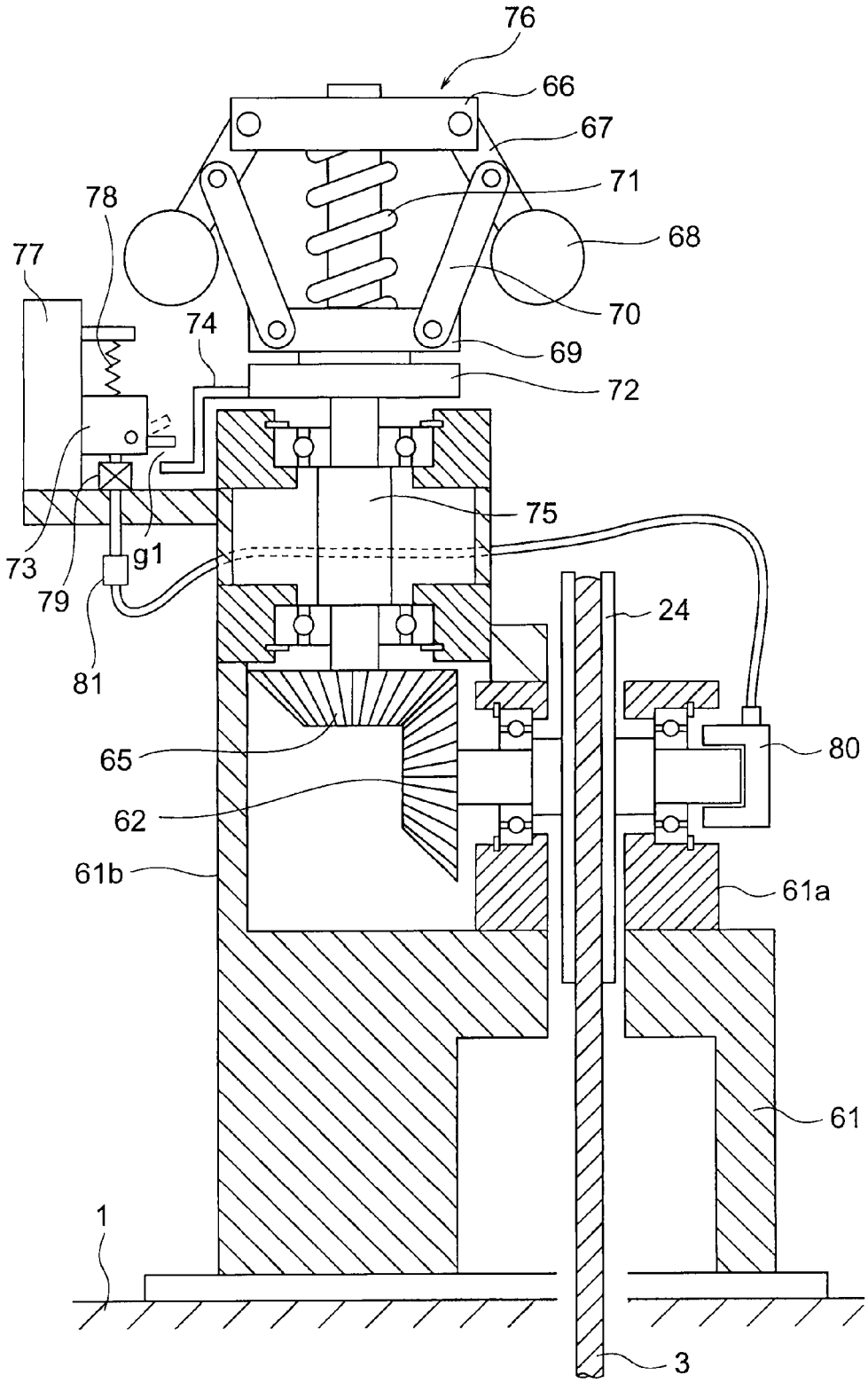
FIG. 9 is a sectional view of the speed governor for the elevator according to a third embodiment of the present invention.

Next, FIG. 9 is a sectional view of the speed governor for the elevator according to a third embodiment of the present invention. In the drawing, the governor sheave supporting portion 61*a* and the rotary body supporting portion 61*b* are provided to the support table 61. The governor sheave 24 is rotatably supported by the governor sheave supporting portion 61*a*. The rotary shaft of the governor sheave 24 is horizontally arranged.

The governor rope 12 is wound around the outer circumferential portion of the governor sheave 24. As a result, the governor sheave 24 is rotated in the first direction along with the ascent of the car 1, whereas the governor sheave 24 is rotated in the second direction which is opposite to the first direction along with the descent of the car 1.

The first bevel gear 62 is fixed to the rotary shaft of the governor sheave 24. A first vertical shaft 75 is rotatably held by the rotary body supporting portion 61*b* therein. The second bevel gear 65 which meshes with the first bevel gear 62 is fixed to a lower end portion of the vertical shaft 75.

A speed detecting mechanism (flyball speed governing mechanism) 76 is provided to the vertical shaft 75. The speed detecting mechanism 76 detects based on the rotation of the vertical shaft 75 that the running speed of the car 1 has reached the first threshold value and the second threshold value. The first threshold value is a threshold value for the ascent of the car 1, and is set about 1.3 times as large as the rated speed for ascent. The second threshold value is a threshold value for the descent of the car 1, and is set about 1.3 times as large as the rated speed for descent. Therefore, the second threshold value is set lower than the first threshold value.

The speed detecting mechanism 76 includes the upper rotary plate 66, the plurality of support arms 67, the plurality of flyballs 68, the lower rotary plate 69, the plurality of links 70, the balance spring 71, the driven plate 72, the detection switch 73, and the operating member 74.

The upper rotary plate 66 is fixed to an upper end portion of the vertical shaft 75 and is rotated with the vertical shaft 75 in an integrated fashion. A proximal end portion (upper end portion) of each of the support arms 67 is connected rockably to the upper rotary plate 66. The flyball 68 is fixed to a distal end portion (lower end portion) of each of the support arms 67. The lower rotary plate 69 surrounds the vertical shaft 75 below the upper rotary plate 66.

The links 70 are respectively connected between the lower rotary plate 69 and the support arms 67. As a result, the lower rotary plate 69 is rotated together with the upper rotary plate 66. Moreover, each of the flyballs 68 is displaced obliquely upward by the centrifugal force with the proximal end portion of each of the support arms 67 being as a center. As a result, the lower rotary plate 69 is displaced upward.

The balance spring 71 is a compression spring, and is provided between the upper rotary plate 66 and the lower rotary plate 69. The driven plate 72 surrounds the vertical shaft 75 below the lower rotary plate 69. The driven plate 72 is connected to the lower rotary plate 69 to follow the vertical displacement of the lower rotary plate 69. Moreover, the rotation of the lower rotary plate 69 is not transmitted to the driven plate 72.

The detection switch 73 is provided to the rotary body supporting portion 61*b* to be vertically movable. The operating member 74 is fixed to the driven plate 72 to operate the detection switch 73.

The vertical shaft 75 is rotated at a speed according to the running speed of the car 1. At this time, the flyballs 68 are subjected to the centrifugal force corresponding to the rotating speed of the vertical shaft 75, that is, the running speed of the car 1. Then, when the running speed of the car 1 becomes a predetermined value or larger, the flyballs 68 are displaced obliquely upward against the balance spring 71. With this displacement, the lower rotary plate 69, the driven plate 72, and the operating member 74 are displaced upward. Specifically, the operating member 74 is vertically displaced according to the rotating speed of the governor sheave 24.

Figure 10:
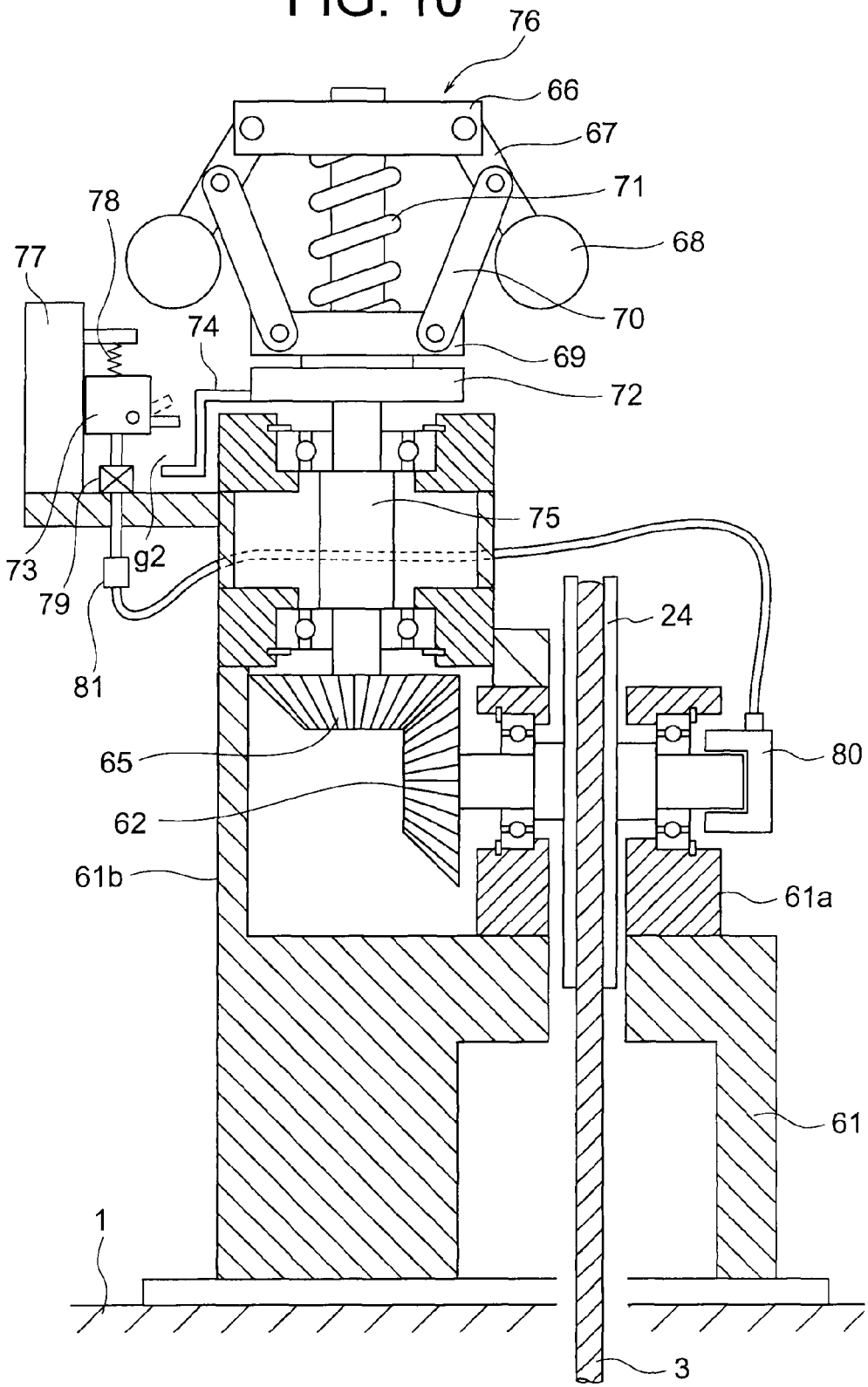
FIG. 10 is a sectional view illustrating a state where a detection switch illustrated in FIG. 9 is displaced to a second position.

A guide body 77 for guiding the vertical displacement of the detection switch 73 is provided to the rotary body supporting portion 61*b*. The detection switch 73 can be displaced between a first position illustrated in FIG. 9 and a second position illustrated in FIG. 10. When the detection switch 73 is located at the first position, a predetermined distance g1 is ensured between an operating piece of the detection switch 73 and the operating member 74 if the flyballs 68 are not displaced by the centrifugal force.

Moreover, when the detection switch 73 is located at the second position, a predetermined distance g2 (g2>g1) is ensured between the operating piece of the detection switch 73 and the operating member 74 if the flyballs 68 are not displaced by the centrifugal force.

A compression spring 78 for biasing the detection switch 73 to hold the same at the first position and an actuator 79 for displacing the detection switch 73 to the second position against the compression spring 78 are provided to the rotary body supporting portion 61*b*. As the actuator 79, the electromagnetic actuator including the solenoid coil is used.

A DC generator 80 for generating the current by the rotation of the governor sheave 24 is provided to the governor sheave supporting portion 61*a*. The actuator 79 changes an initial position of the detection switch 73 (position when the flyballs 68 are not displaced by the centrifugal force) between the first position and the second position according to whether or not the energization from the DC generator 80 is performed.

A rectifier circuit 81 is electrically connected between the solenoid coil of the actuator 79 and the DC generator 80. The rectifier circuit 81 allows the solenoid coil to be energized with any one of the positive current and the negative current. Specifically, the rectifier circuit 81 allows the current to flow from the DC generator 80 to the solenoid coil only when the rotating direction of the governor sheave 24 is a predetermined one of the first and second directions.

In this example, the rectifier circuit 81 allows the current to flow from the DC generator 80 to the actuator 79 when the rotating direction of the governor sheave 24 is the first direction, specifically, when the car 1 ascends. Moreover, when the current from the DC generator 80 to the actuator 79 is interrupted by the rectifier circuit 81, the detection switch 73 is located at the first position with respect to the operating member 74. Further, when the current is made to flow from the DC generator 80 to the actuator 79, the detection switch 73 is displaced to the second position which is separated further away from the operating member 74 than the first position.

The first position is pre-adjusted to correspond to the second threshold value. Moreover, the second position is pre-adjusted to correspond to the first threshold value.

In the speed governor as described above, the DC generator 80 for generating the current by the rotation of the governor sheave 24 is provided to the governor sheave supporting portion 61*a*, whereas the rectifier circuit 81 is provided between the DC generator 80 and the actuator 79 for changing distance between the detection switch 73 and the operating member 74. In this manner, the actuator 79 is energized with the current from the DC generator 80 to separate the detection switch 73 away from the operating member 74 only when the car 1 ascends. Therefore, the running speed of the car 1 can be monitored using different threshold values respectively for the ascent and the descent of the car 1 without requiring external power feeding.

Moreover, in the case where the detection switch 73 cannot be moved away from the first position for some reason, the car 1 is brought to an emergency stop at the second threshold value which is lower than the first threshold value regardless of the running direction of the car 1. Therefore, a fail-safe function is ensured, thereby providing high reliability even at the time of occurrence of a failure.

Though the detection switch 73 is displaced by the actuator 79 in the third embodiment, it is sufficient that a relative positional relation between the detection switch 73 and the operating member 74 is changed, and therefore, an initial position of the operating member 74 may be changed by the actuator 79.

Moreover, though the safety gear operating mechanism has not been described in the third embodiment, it is apparent that the safety gear operating mechanism may be provided to the speed governor according to the third embodiment.

Further, though the case where the rated speed for ascent is higher than the rated speed for descent has been described in the above-described example, it is possible to set the rated speed for descent higher than the rated speed for ascent in some cases.

The invention claimed is:

1. A speed governor for an elevator, comprising:

a governor sheave, around which a governor rope connected to a car is wound, the governor sheave being rotated in a first direction along with ascent of the car and being rotated in a second direction opposite to the first direction along with descent of the car;

a first speed detecting mechanism provided to the governor sheave to detect based on rotation of the governor sheave that a running speed of the car has reached a first threshold value;

a rotary body to be rotated by transmission of the rotation of the governor sheave;

a second speed detecting mechanism provided to the rotary body to detect based on rotation of the rotary body that the running speed of the car has reached a second threshold value smaller than the first threshold value;

a clutch mechanism provided between the governor sheave and the rotary body to transmit and interrupt rotation between the governor sheave and the rotary body;

a DC generator for generating a current by the rotation of the governor sheave;

an actuator for performing switching between transmission and interruption of rotation by the clutch mechanism according to whether or not energization from the DC generator is performed; and a rectifier circuit for allowing the current to flow from the DC generator to the actuator only when a rotating direction of the governor sheave is a predetermined one of the first direction and the second direction.

2. A speed governor for an elevator according to claim 1, wherein:

when the rotating direction of the governor sheave is the first direction, the current is made to flow from the DC generator to the actuator by the rectifier circuit;

when the current from the DC generator to the actuator is interrupted by the rectifier circuit, the rotation of the governor sheave is transmitted to the rotary body by the clutch mechanism; and when the current is made to flow from the DC generator to the actuator, the transmission of the rotation by the clutch mechanism is interrupted by the actuator.

3. A speed governor for an elevator according to claim 1, further comprising a safety gear operating mechanism for detecting based on the rotation of the rotary body that the running speed of the car has reached a third threshold value larger than the second threshold value to grip the governor rope.

4. A speed governor for an elevator, comprising:

a governor sheave, around which a governor rope connected to a car is wound, the governor sheave being rotated in a first direction along with ascent of the car and being rotated in a second direction opposite to the first direction along with descent of the car;

a speed detecting mechanism comprising an operating member to be displaced according to a rotating speed of the governor sheave and a detection switch operated by the operating member;

a DC generator for generating a current by rotation of the governor sheave;

an actuator for changing a relative positional relation between the operating member and the detection switch according to whether or not energization from the DC generator is performed; and a rectifier circuit for allowing the current to flow from the DC generator to the actuator only when a rotating direction of the governor sheave is a predetermined one of the first direction and the second direction.

5. A speed governor for an elevator according to claim 4, wherein:

when the rotating direction of the governor sheave is the first direction, the current is made to flow from the DC generator to the actuator by the rectifier circuit;

when the current from the DC generator to the actuator is interrupted by the rectifier circuit, the detection switch is located at a first position with respect to the operating member; and when the current is made to flow from the DC generator to the actuator, the detection switch is displaced to a second position further away from the operating member than the first position.

* * * * *